US009893445B1

(12) United States Patent
Ju

(10) Patent No.: US 9,893,445 B1
(45) Date of Patent: Feb. 13, 2018

(54) CONNECTOR ASSEMBLY

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/434,497

(22) Filed: Feb. 16, 2017

(30) Foreign Application Priority Data

Nov. 11, 2016 (CN) ..... 2016 2 1215675

(51) Int. Cl.
*H01R 24/76* (2011.01)
*H01R 12/72* (2011.01)

(52) U.S. Cl.
CPC ..... *H01R 12/721* (2013.01)

(58) Field of Classification Search
CPC ..... H01R 12/79
USPC ..... 439/329, 495, 660, 60, 637, 81
See application file for complete search history.

(56) References Cited

U.S. PATENT DOCUMENTS 4,072,387 A * 2/1978 Sochor ..... H01R 23/722 439/329
5,015,197 A * 5/1991 Redmond ..... H01R 12/721 439/329
5,035,641 A * 7/1991 Van-Santbrink ... H01R 12/7023 439/329
5,132,877 A * 7/1992 Branan ..... H05K 1/119 361/736
6,007,359 A * 12/1999 Kosmala ..... H01R 23/70 439/329
6,250,953 B1 * 6/2001 Niitsu ..... H01R 12/79 439/497
6,321,126 B1 * 11/2001 Kuzma ..... A61N 1/3752 439/909
6,386,905 B1 * 5/2002 Ito ..... H01R 13/025 439/493
6,592,380 B2 * 7/2003 Miyazawa ..... H01R 12/592 439/329
6,846,115 B1 * 1/2005 Shang ..... H01R 12/7076 385/92
7,144,256 B2 * 12/2006 Pabst ..... H01R 12/79 439/67
7,156,678 B2 * 1/2007 Feldman ..... H01R 4/024 439/326

(Continued)

*Primary Examiner* — Neil Abrams
(74) *Attorney, Agent, or Firm* — Locke Lord LLP; Tim Tingkang Xia, Esq.

(57) ABSTRACT

A connector assembly includes an electrical connector and an adapter board. The electrical connector includes an insulating body having an insertion space and first terminals disposed in the insulating body. Each first terminal has a first contacting portion exposed to the insertion space and a first soldering portion soldered to a circuit board. The adapter board is inserted in the insertion space, one end of which having first and second conducting regions located on upper and lower surfaces thereof. The first conducting region has first contact pads conducts the first contacting portions. Second terminals are arranged on the lower surface, each having a second contacting portion and a second soldering portion. The second conducting region has second contact pads conducts the second soldering portions. The second contacting portions conduct the circuit board. The first and second terminals are staggered in a vertical direction.

20 Claims, 9 Drawing Sheets

(56) References Cited

U.S. PATENT DOCUMENTS 7,261,579 B2 * 8/2007 Ku ..... H01R 13/2442 439/289
7,374,429 B2 * 5/2008 Cronch ..... H01R 12/79 439/496
7,445,504 B1 * 11/2008 Zhang ..... H01R 13/6594 439/607.01
7,497,715 B2 * 3/2009 Wu ..... H01R 12/57 439/329
7,628,655 B1 * 12/2009 Chen ..... H01R 12/721 439/60
7,663,561 B2 * 2/2010 Hisaeda ..... B32B 17/10036 343/713
7,872,873 B2 * 1/2011 Hiew ..... G06F 1/1632 361/715
7,892,007 B2 * 2/2011 Scherer ..... H01R 23/6873 439/329
8,550,837 B2 * 10/2013 Tagawa ..... H01R 12/7023 439/345
8,550,849 B2 * 10/2013 Yamaji ..... H01R 13/6581 439/495
8,727,803 B2 * 5/2014 Kurachi ..... H01R 12/88 439/497
8,858,249 B2 * 10/2014 Honda ..... H01R 13/648 439/260
8,932,083 B2 * 1/2015 Ho ..... H01R 12/613 439/660
8,939,794 B2 * 1/2015 Mason ..... H01R 9/0515 439/581
9,039,429 B2 * 5/2015 Shimoji ..... H01R 12/728 439/81
2011/0306229 A1 * 12/2011 Katsui ..... H01R 13/629 439/345
2017/0338575 A1 * 11/2017 Shiraishi ..... H01R 12/716

* cited by examiner

CONNECTOR ASSEMBLY

CROSS-REFERENCE TO RELATED APPLICATIONS

This non-provisional application claims priority to and benefit of, under 35 U.S.C. §119(a), Patent Application No. 201621215675.9 filed in P.R. China on Nov. 11, 2016, the entire content of which is hereby incorporated by reference.

FIELD OF THE INVENTION

The present invention relates to a connector assembly, and in particular to a connector assembly with an adapter board.

BACKGROUND OF THE INVENTION

A conventional socket connector is mounted on a circuit board. The socket connector has an insulating body, the front end of the insulating body is provided with an insertion space, and multiple conductive terminals are arranged in two rows and respectively fixedly on the insulating body. Each conductive terminal has a contacting portion and a soldering portion. The contacting portions are arranged correspondingly in two rows and exposed in the insertion space. The soldering portions are used for being soldered to the circuit board. In order to implement the transmission of signals, a matching plug connector is inserted in the insertion space. Of course, the plug connector is provided with multiple contact terminals correspondingly as well. The contact terminals are arranged in an upper row and a lower row. Each contact terminal has a conducting portion and a soldering plate. The conducting portions are correspondingly in contact with the contacting portions, and the soldering plates are soldered on one end of an adapter board. Conductive lines and processing chips are arranged in the adapter board. The other end of the adapter board is in contact with a cable. Thus, signals can be transmitted between the cable and the circuit board. However, because a signal outputted by the circuit board has to sequentially pass through the socket connector, the plug connector and the adapter board before arriving at the cable, the transmission process is complex, the transmission path is long, and the interference and attenuation of signals are severe. Moreover, a large space is occupied, which does not accord with the development trends of ultra-thin, small-size electronic products. Furthermore, the cost for materials, production, and machining and assembly are high. As a result, the competitiveness of electronic products is decreased greatly.

Therefore, a heretofore unaddressed need exists in the art to address the aforementioned deficiencies and inadequacies.

SUMMARY OF THE INVENTION

In one aspect, the present invention relates to a connector assembly that directly conducts a cable to a circuit board through an adapter board to reduce the interference and attenuation of signals.

In certain embodiments, a connector assembly is configured to be mounted electrically on a circuit board. The connector assembly includes an electrical connector and an adaptor board. The electrical connector is configured to be electrically mounted on the circuit board, and has an insulating body and multiple first terminals arranged on the insulating body. The insulating body is provided with an insertion space. Each of the first terminals has a first contacting portion exposed to the insertion space and a first soldering portion for being soldered to the circuit board. The adapter board is inserted in the insertion space. One end of the adapter board is provided with a first conducting region and a second conducting region. The first conducting region and the second conducting region are located respectively on the upper surface and the lower surface of the adapter board. The first conducting region is provided with multiple first contact pads that are exposed to the insertion space and are correspondingly in electrical contact with the first contacting portions. Multiple second terminals are disposed on the lower surface of the adapter board. Each of the second terminals has a second contacting portion and a second soldering portion. The second conducting region is provided with multiple second contact pads that are exposed to the insertion space and are correspondingly in electrical contact with the second soldering portions. The second contacting portions are in electrical contact with the circuit board. The second terminals and the first terminals are staggered in the vertical direction.

In certain embodiments, the first terminals are arranged in a row and are all ground terminals, the second terminals are arranged in a row and are all signal terminals, and the horizontal projections of only two second terminals are between the horizontal projections of two neighboring first terminals.

In certain embodiments, the first contact pads and the second contact pads are all staggered in the vertical direction.

In certain embodiments, the first contacting portions and the first contact pads are in elastic urging contact, and the second contacting portions and the circuit board are in elastic urging contact.

In certain embodiments, each of the second contacting portions bends and extends downward from corresponding one of the second soldering portions, the adapter board is provided with multiple reserved slots corresponding to the second contacting portions, an urging portion is formed by bending upward from each of the second contacting portions, each of the reserved slots has a stopping block and the urging portions respectively urge against the stopping blocks of the adapter board.

In certain embodiments, two fixing members are respectively fixedly on two sides of the insulating body. The two fixing members are located respectively on the outer sides of the outermost first terminals, and the fixing members and the first terminals have the same structure and are arranged in a row.

In certain embodiments, the first terminals are cutting-type terminals, and the plate surface of each first terminal is perpendicular to the plate surface of each second terminal.

In certain embodiments, the insulating body is provided with a base and an extension portion extending forward from the front end of the base. The second terminals are fixed on the base and extend to the extension portion. The size in the vertical direction of the extension portion is less than the size of the base. The base, the extension portion and the circuit board jointly define the insertion space, and the first terminals and the second terminals are located respectively on the two opposite sides of the inner side of the insertion space.

In certain embodiments, the other end of the adapter board is provided with a connecting region. The connecting region is located out of the insertion space. Both the first conducting region and the second conducting region are electrically conducted with the connecting region. A cable is soldered to the connecting region. The cable is provided with multiple core wires which are correspondingly electrically connected to the first contact pads and the second contact pads.

In another aspect, the present invention relates a connector assembly for being electrically mounted on a circuit board. In certain embodiments, a connector assembly includes an electrical connector for being electrically mounted on the circuit board. The electrical connector includes an insulating body, multiple first terminals and multiple third terminals disposed on the insulating body, and an adapter board. The first terminals and the third terminals are configured to be electrically connected to the circuit board. The insulating body is provided with an insertion space. Each of the first terminals has a first contacting portion exposed to one side of the insertion space, and each of the third terminals has a third contacting portion exposed to the other side of the insertion space. The adapter board is inserted in the insertion space. One end of the adapter board is provided with a first conducting region and a second conducting region. The first conducting region and the second conducting region are located respectively on the upper surface and the lower surface of the adapter board. The first conducting region is provided with multiple first contact pads that are exposed to the insertion space and are correspondingly in electrical contact with the first contacting portions. Multiple second terminals are arranged on the lower surface of the adapter board. Each of the second terminals has a second contacting portion and a second soldering portion. The second conducting region is provided with multiple second contact pads that are exposed to the insertion space and are correspondingly in electrical contact with the second soldering portions. The second contacting portions are correspondingly in electrical contact with the third contacting portions. The second terminals and the first terminals are arranged staggerly in the vertical direction.

In certain embodiments, the first contact pads and the second contact pads are all arranged staggerly in the vertical direction.

In certain embodiments, the first contacting portions and the first contact pads are in elastic urging contact, and the second contacting portions and the circuit board are in elastic urging contact.

In certain embodiments, the first terminals are arranged in a row and are all ground terminals, the second terminals are arranged in a row and are all signal terminals, and the horizontal projections of only two second terminals are between the horizontal projections of two neighboring first terminals.

In certain embodiments, the insulating body includes a base and an extension portion extending forward from the base. Multiple first terminal slots are arranged concavely forward from the rear end surface of the base, and the extension portion is provided with multiple receiving slots which correspondingly communicate with the first terminal slots. Each first terminal has a first fixing portion fixed in the first terminal slot. The first contacting portions are contained in the receiving slots and exposed to the insertion space. Multiple second terminal slots are arranged concavely from the bottom surface of the base. Each third terminal has a third fixed portion fixed in the second terminal slot. The third contacting portions protrude out of the second terminal slots and are located under the first contacting portions.

In a further aspect, the present invention relates to a connector assembly for being electrically mounted on a circuit board. The circuit board is provided with multiple conductive sheets and multiple soldering pads respectively along the front and back (longitudinal) direction. In certain embodiments, the connector assembly includes an electrical connector for being electrically mounted on the circuit board. The electrical connector includes an insulating body, multiple first terminals arranged on the insulating body, and an adapter board. An insertion space is arranged backward from the front end surface of the insulating body. Each first terminal has a first fixing portion fixed on the insulating body. An elastic first contacting portion extends forward from each first fixing portion and is exposed to one side of the insertion space, and the conductive sheets are located on the other side of the insertion space. A first soldering portion extends backward from each first fixing portion and is located out of the insulating body in order to be electrically connected to the corresponding soldering pad. The adapter board is inserted in the insertion space. One end of the adapter board is provided with a first conducting region and a second conducting region. The first conducting region and the second conducting region are located respectively on the upper surface and the lower surface of the adapter board. The first conducting region is provided with multiple first contact pads that are exposed to the insertion space. The first contacting portions are located above the adapter board and correspondingly in electrical contact with the first contact pads. The second conducting region is provided with multiple second contact pads. Multiple second terminals are arranged on the lower surface of the adapter board. Each of the second terminals has a second contacting portion and a second soldering portion. The second soldering portions are correspondingly in electrical contact with the second contact pads, and the second contacting portions all downwardly elastically urge against the conductive sheets to form electrical connection.

In certain embodiments, the first contact pads are located behind the second contact pads along the longitudinal direction, and are located in front of the conductive sheets.

In certain embodiments, the second terminals and the first terminals are arranged staggerly in the vertical direction.

In certain embodiments, the first terminals are arranged in a row and are all ground terminals, the second terminals are arranged in a row and are all signal terminals, and the horizontal projections of only two second terminals are between the horizontal projections of two neighboring first terminals.

In certain embodiments, the second contacting portions bend and extend downward from the second soldering portions, the adapter board is provided with multiple reserved slots corresponding to the second contacting portions, an urging portion is formed by bending upward from each second contacting portion, each of the reserved slots has a stopping block, and the urging portions urge against the stopping blocks of the adapter board.

In certain embodiments, the other end of the adapter board is provided with a connecting region, and the connecting region is located out of the insertion space. Both the first conducting region and the second conducting region are electrically conducted with the connecting region. A cable is soldered to the connecting region. The cable has multiple core wires correspondingly electrically connected to the first contact pads and the second contact pads.

Compared with the related art, certain embodiments of the present invention have the following beneficial advantages.

In the above-mentioned connector assembly, the first conducting region of the adapter board is provided with the first contact pads that are exposed to the insertion space and are correspondingly in electrical contact with the first contacting portions, the second conducting region is provided with the second contact pads that are exposed to the insertion space and are correspondingly in electrical contact with the second soldering portions, the second contacting portions are configured to be in electrical contact with the circuit board. Thus, the adapter board can directly conduct signals of the circuit board to the cable, the path of electrical conduction is shortened, and the interference and attenuation of the signals are reduced. In addition, since the second terminals and the first terminals are staggered in the vertical direction, the space is saved, and the cost is reduced.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
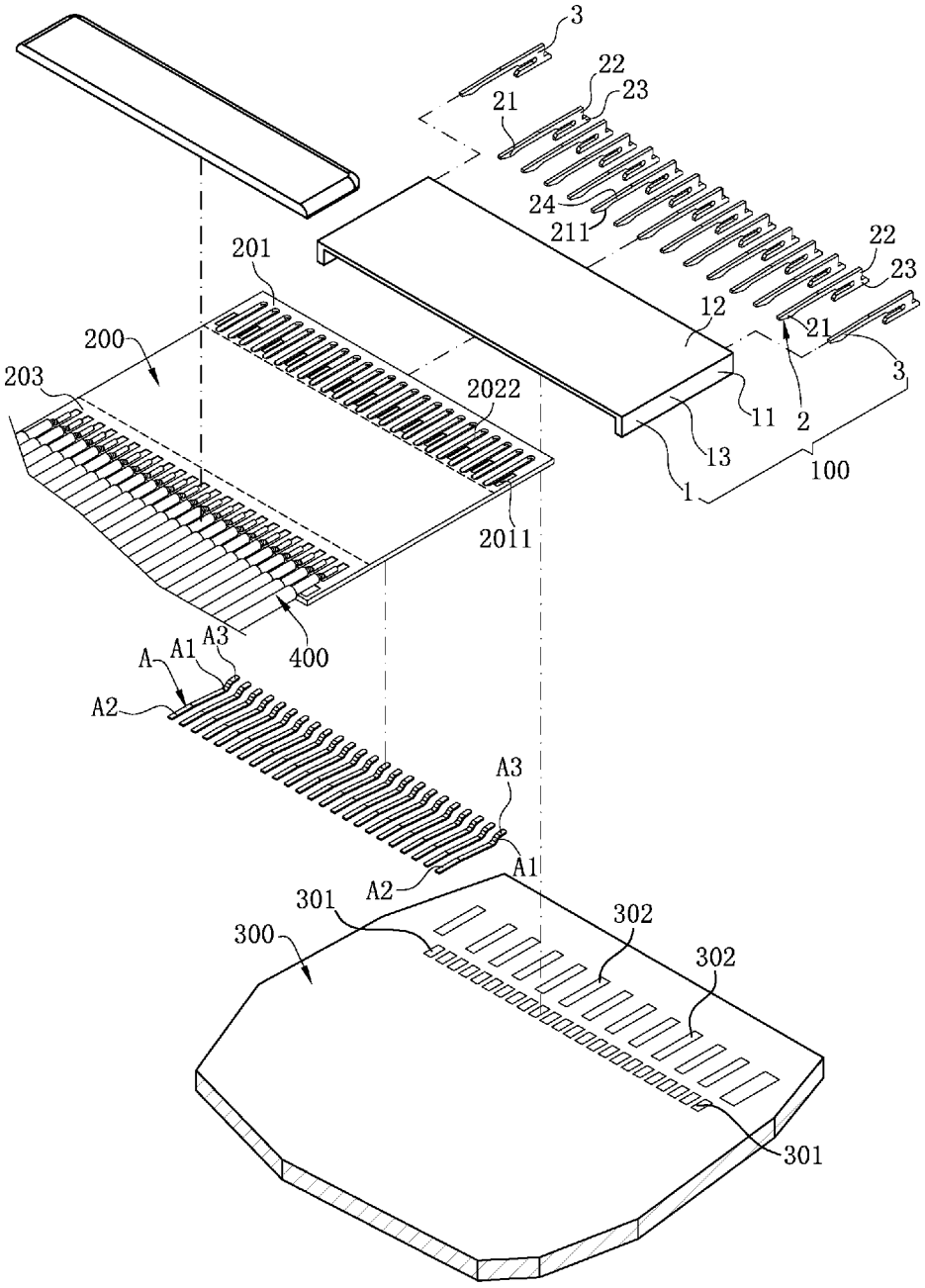
FIG. 1 is a schematic three-dimensional exploded view of a connector assembly according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to a connector assembly.

Figure 2:
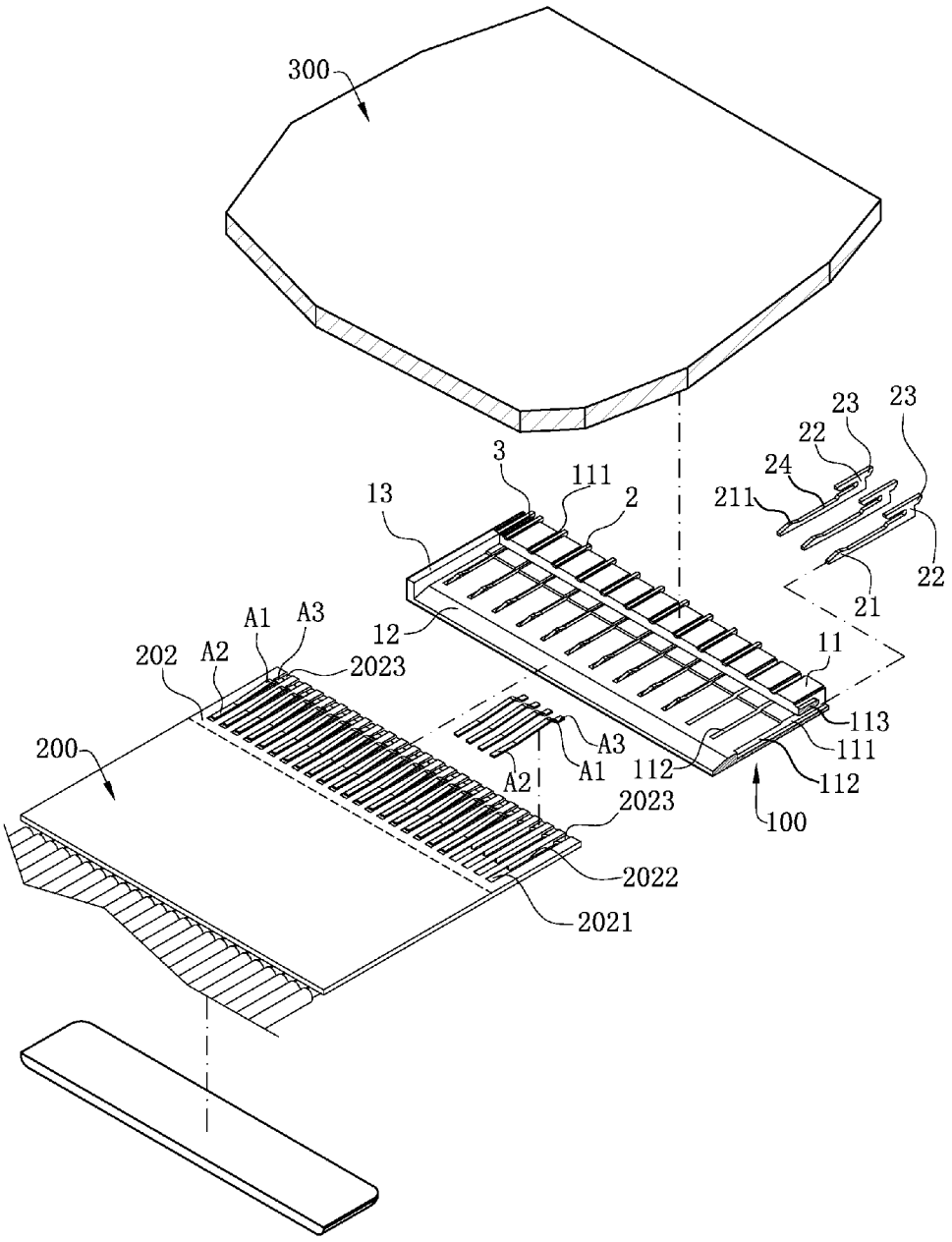
FIG. 2 is a schematic three-dimensional exploded view of the connector assembly viewed from another viewing angle.

As shown in FIG. 1 and FIG. 2, a connector assembly according to certain embodiments of the present invention is used for being electrically connected to a circuit board 300. The connector assembly includes an electrical connector 100. The electrical connector 100 includes an insulating body 1 and multiple first terminals 2 arranged on the insulating body 1. The circuit board 300 is provided with multiple conductive sheets 301 and multiple soldering pads 302 respectively along the longitudinal direction. The first terminals 2 are configured to be soldered to the soldering pads 302 of the circuit board 300. An adapter board 200 is inserted in the insulating body 1. One end of the adapter board 200 is provided with a first conducting region 201 and a second conducting region 202. The first conducting region 201 is electrically connected to the first terminals 2, the second conducting region 202 is electrically connected to the conductive sheets 301 of the circuit board 300. The other end of the adapter board 200 is provided with a connecting region 203, and the connecting region 203 is electrically connected to a cable 400, so that the connector assembly is formed.

Figure 3:
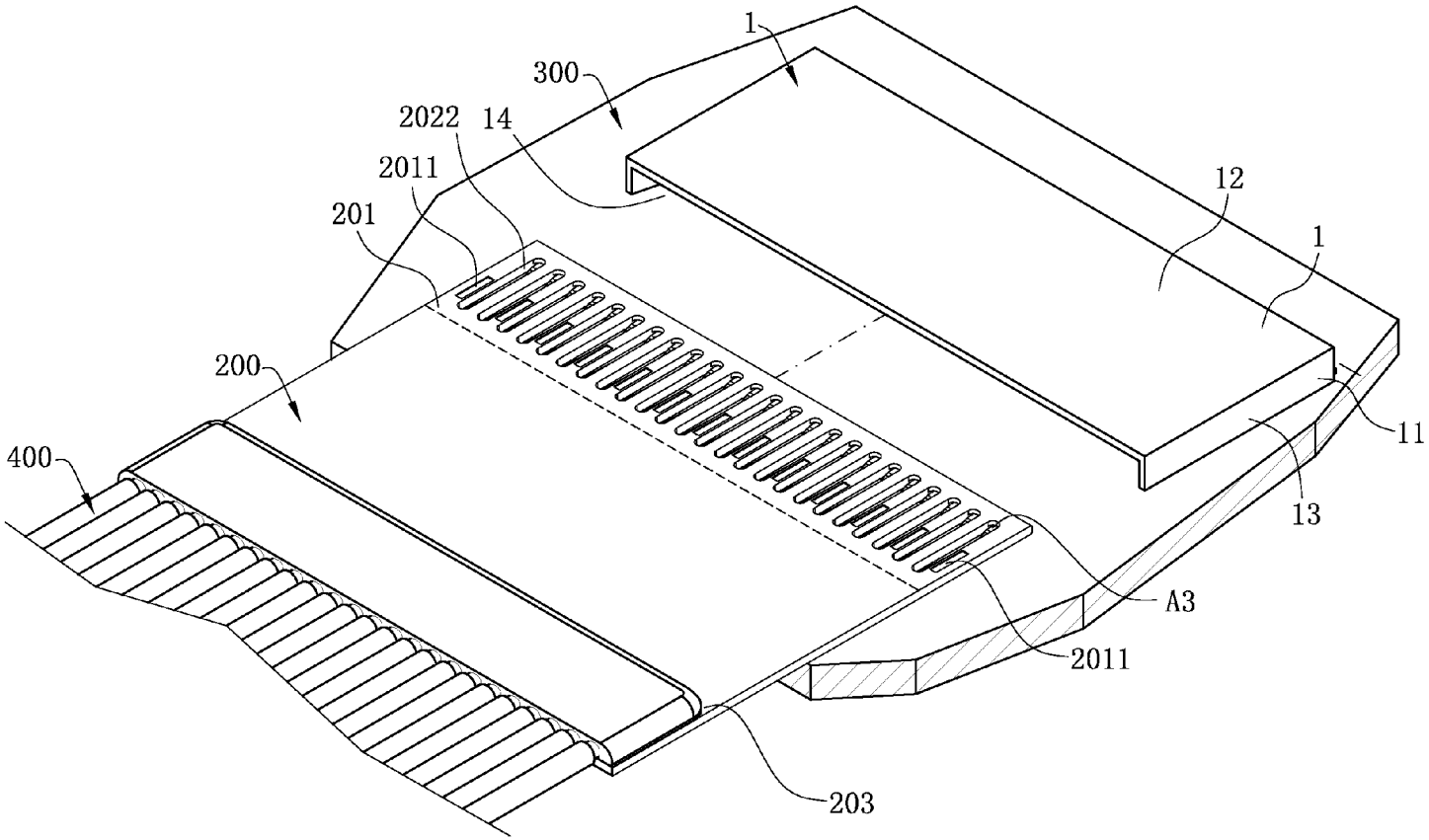
FIG. 3 is a schematic partial assembly view of the connector assembly.

As shown in FIGS. 1-3, the insulating body 1 has a base 11 and an extension portion 12 extending forward from the front end of the base 11. The size, in the vertical direction, of the extension portion 12 is less than the size of the base 11. That is, the thickness of the extension portion 12 is less than the thickness of the base 11. The base 11 is mounted on the circuit board 300, the extension portion 12 is hanging over the circuit board 300, and the base 11, the extension portion 12 and the circuit board 300 jointly form an insertion space 14 with an opening at the front end in which the adapter board 200 can be inserted therein. Since the base 11, the extension portion 12 and the circuit board 300 jointly form the insertion space 14, the insertion space 14 does not need to be formed by separately concaving the insulating body 1. Consequently, the height of the insulating body 1 is reduced, and the size of the electrical connector 100 is reduced effectively. In this embodiment, the insulating body 1 and the circuit board 300 jointly form the insertion space 14, and in other embodiments, the insertion space 14 can also be formed by only concaving the insulating body 1. Two sidewalls 13 respectively extend vertically downward from both side edges of the extension portion 12. The two sidewalls 13, the bottom of the extension portion 12 and the front end surface of the base 11 jointly define a retaining recess (not labeled) with a bottom opening, and the retaining recess is superposed with the insertion space 14.

As shown in FIGS. 1-3, multiple first terminal slots 111 are arranged concavely forward from the rear end surface of the base 11, multiple receiving slots 112 are arranged concavely along the longitudinal direction in the bottom of the extension portion 12 to correspondingly communicate with the first terminal slots 111. Each of the first terminals 2 is fixed in corresponding one of the first terminal slots 111 and extends to corresponding one of the receiving slot 112. An engagement block 113 is protruded backward from the front end of each first terminal slot 111 to engage with and fix corresponding one of the first terminals 2.

Figure 6:
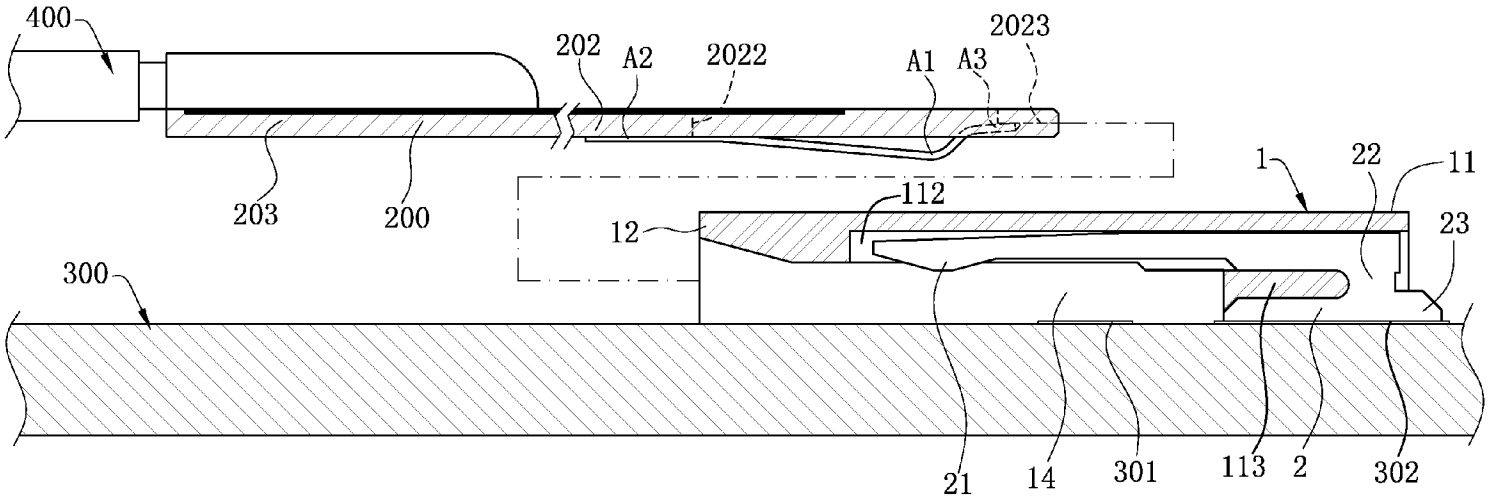
FIG. 6 is a sectional view of the connector assembly, where an adapter board is not inserted in an electrical connector.

As shown in FIGS. 1, 2 and 6, the first terminals 2 are arranged in a row on the insulating body 1 and are all ground terminals. The first terminals 2 are blanked terminals. First contacting portions 21 are located above the first conducting region 201. All of the first terminals 2 have the same width, and thereby are convenient for blanking and forming. Each of the first terminals 2 has a first fixing portion 22 fixed in corresponding one of the first terminal slots 111. The first fixing portion 22 is has a shape of U. The first fixing portion 22 is formed by extending backward for a certain distance from the first contacting portion 21, then extending vertically downward for a short distance, and finally extending reversely toward the direction of the first contacting portion 21 for a distance. The first fixing portion 22 clamps the upper and lower sides of the corresponding engagement block, so that the first terminal 2 can be prevented from shaking, and thereby the first terminals 2 can be inserted steadily in the adapter board 200. A first contacting portion 21 extends forward from each first fixing portion 22, and the first contacting portions 21 are located on the same side of the insertion space 14 and elastically urge against the adapter board 200 to form electrical contact. Each first contacting portion 21 is provided with an elastic arm 24 and a contacting protrusion 211 protruded downward from the elastic arm. The elastic arm is contained in the receiving slot, the protruded contacting protrusion is exposed to the insertion space 14, and the elastic arm provides sufficient elastic force for the first contacting portion 21 to elastically urge against the adapter board 200. A first soldering portion 23 horizontally extends backward from each first fixing portion 22, and the first soldering portion 23 are configured to be soldered to the circuit board 300, and are arranged in the same row on the circuit board 300.

Figure 5:
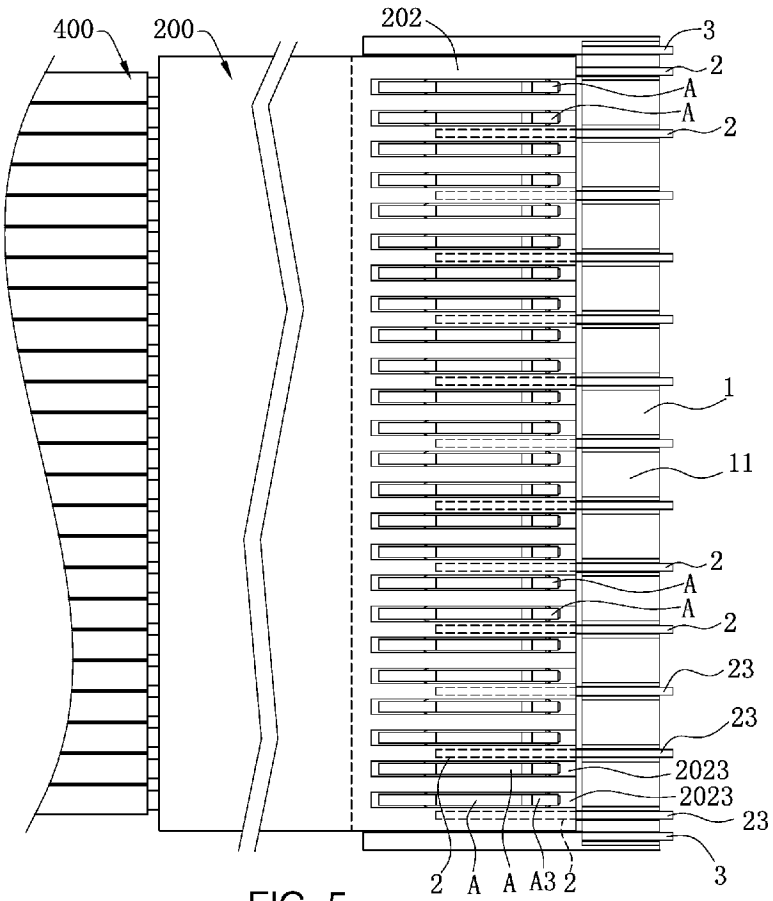
FIG. 5 is a schematic bottom view of the connector assembly.

As shown in FIGS. 1, 2 and 5, two fixing members 3 are respectively fixed on two sides of the insulating body 1. The fixing members 3 are configured to fix the insulating body 1 on the circuit board 300. The two fixing members 3 are located respectively on the outer sides of the outermost first terminals 2. The fixing members 3 and the first terminals 2 have the same structure and are arranged in a row. As a result, the fixing members 3 and the first terminals 2 can be formed by blanking through the same material, separate forming of the fixing members 3 are avoided, cost is reduced, the efficiency of production is increased, and moreover, batch production is benefited.

Figure 7:
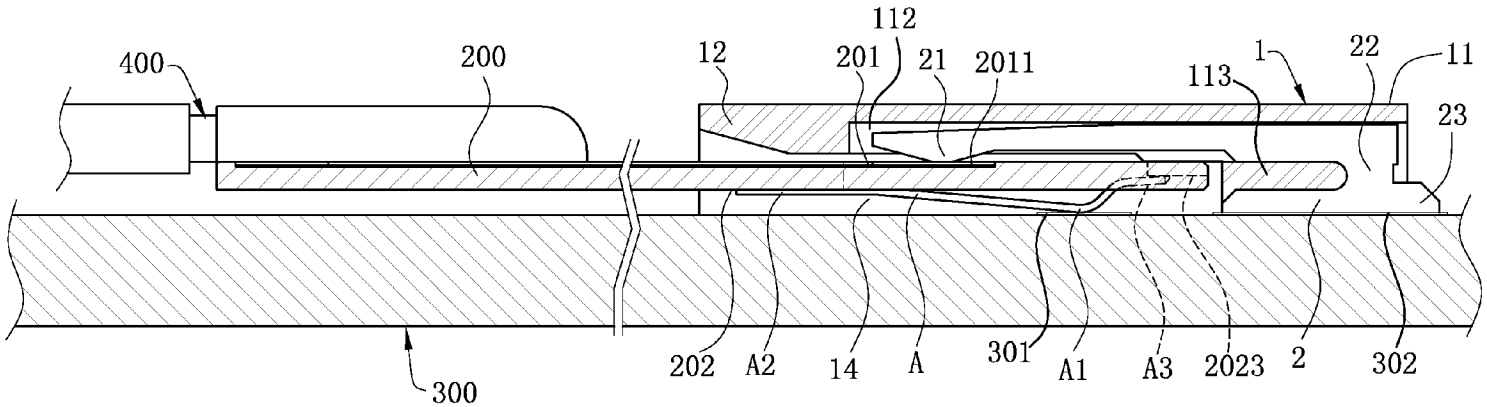
FIG. 7 is a sectional view of the connector assembly, where the adapter board has been inserted in the electrical connector.

As shown in FIGS. 1, 2 and 7, the adapter board 200 is inserted in the insertion space 14. One end of the adapter board 200 is provided with the first conducting region 201 and the second conducting region 202. The first conducting region 201 and the second conducting region 202 are located respectively on the upper surface and the lower surface of the adapter board 200. The first conducting region 201 has multiple first contact pads 2011 that are exposed to the insertion space 14 and correspondingly elastically urge against the first contacting portions 21 to form electrical contacts. Multiple second terminals A are arranged on the lower surface of the adapter board 200. Each of the second terminals A has a second contacting portion A1 and a second soldering portion A2. The second conducting region 202 is provided with multiple second contact pads 2021 that are exposed to the insertion space 14 and are correspondingly in electrical contacts with the second soldering portions A2. The first contact pads 2011 and the second contact pads 2021 are all arranged staggerly in the vertical direction. In this embodiment, the second soldering portions A2 are soldered to the second contact pads 2021. In the longitudinal direction, the first contact pads 2011 are located behind the second contact pads 2021 and located in front of the conductive sheets 301, and the second contacting portions A1 are configured to elastically urge against the conductive sheets 301 to form electrical contacts. In this embodiment, the second terminals A and the first terminals 2 are arranged staggerly in the vertical direction. In other embodiments, the second terminals A and the first terminals 2 can also be arranged in one-to-one correspondence in the vertical direction, as long as it is ensured that the second terminals A and the first terminals 2 are located respectively on the two opposite sides of the adapter 200 and urge against the upper and lower sides of the adapter board 200. The first conducting region 201 of the adapter board 200 is provided with the first contact pads 2011 that are exposed out to the insertion space 14 and correspondingly elastically urge against the first contacting portions 21 to form electrical contact, the second conducting region 202 is provided with the second contact pads 2021 that are exposed out to the insertion space 14 and are in corresponding electrical contact with the second soldering portions A2, and the second contacting portions A1 are configured to elastically urge against the conductive sheets 301 of the circuit board 300 to form electrical contact. As a result, the adapter board 200 can directly conduct signals of the circuit board 300 to the cable 400, the path of conduction is shortened, and the interference and attenuation of signals are reduced. In addition, since the second terminals A and the first terminals 2 are arranged staggerly in the vertical direction, the space is saved, and the cost is reduced.

As shown in FIGS. 1, 5 and 7, since the first contacting portions 21 have elasticity, the first contacting portions 21 and the first contact pads 2011 are in elastic urging contact. Since a plate is bent to form the second terminals A, the second terminals A are elastic terminals. That is, the second contacting portions A1 and the circuit board 300 are in elastic urging contact. The plate surfaces of the first terminals 2 are perpendicular to the plate surfaces of the second terminals A. The first contacting portions 21 are located above the first contact pads 2011 to elastically urge against the first contact pads 2011, and the second contacting portions A1 are located above the circuit board 300 to elastically urge against the conductive sheets 301. In other words, the first terminals 2 and the second terminals A respectively elastically clamp the upper side and lower side of the adapter board 200 and respectively electrically urge against the first contact pads 2011 and the conductive sheets 301 of the circuit board 300, so that the adapter board 200 can be supported stably. As a result, the circuit board 300 and the electrical connector 100 can maintain stable electrical connection, and thereby the connector assembly has good signal transmission performance. The first terminals 2 are arranged in a row and are all ground terminals. The second terminals A are arranged in a row and are all signal terminals, and are high-speed signal terminals. In other embodiments, the second terminals A can also be low-speed signal terminals. The horizontal projections of only two second terminals A are between the horizontal projections of two neighboring first terminals 2. That is, a first terminal 2 is arranged between a pair of second terminals A. As a result, from the aspect of the horizontal projections of the first terminals 2 and the second terminal A, the arrangement sequence of the first terminals 2 and the second terminals A is ground-signal-signal-ground in sequence, and this sequential arrangement can be repeated. Thus, the arrangement of the first terminals 2 is used to shield the signal interference between two neighboring pairs of second terminals A, and to reduce crosstalk interference. Moreover, the first terminals 2 are blanked terminals, and thereby the shielding effect of the first terminals 2 is better. In addition, since the first contacting portions 21 are located over the second contacting portions A1, the first terminals 2 can further shield crosstalk signals above the second contacting portions A1, and thereby the high-frequency effect of the electrical connector 100 is guaranteed. In this embodiment, the first terminals 2 are ground terminals, and the second terminals A are signal terminals. In other embodiments, the first terminals 2 can also be signal terminals, the second terminals A can also be ground terminals, and a pair of first terminals 2 are between each two neighboring second terminals A, as long as it is ensured that the sequence of the first terminals 2 and the second terminals A is arranged repeatedly according to a ground-signal-signal-ground sequence.

Figure 4:
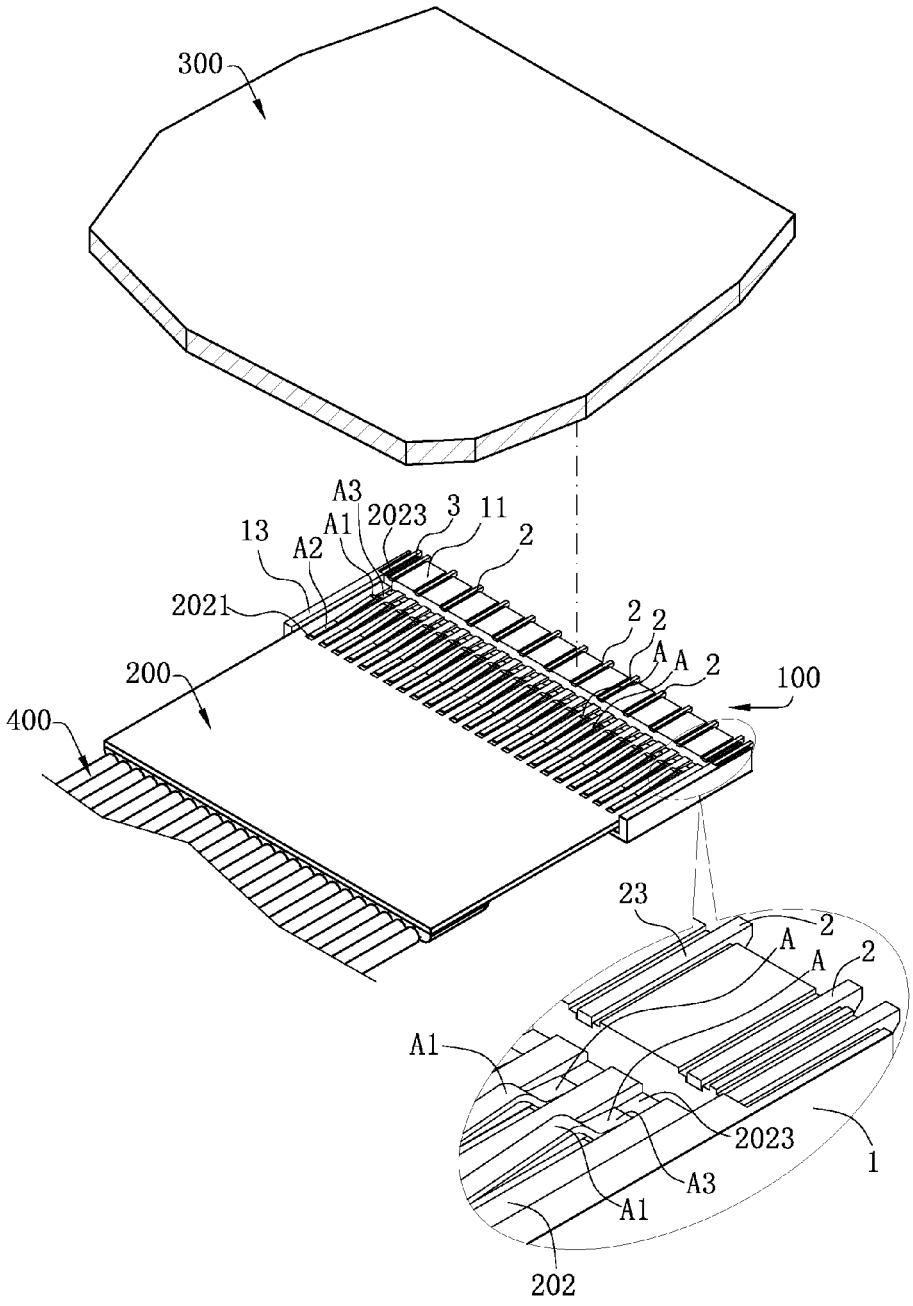
FIG. 4 is a schematic partial assembly view of the connector assembly viewed from another viewing angle.

As shown in FIGS. 2, 4 and 5, because the adapter board 200 is provided with multiple reserved slots 2022 corresponding to the second contacting portions A1, when the adapter board 200 is inserted into the insertion space 14, the second contacting portions A1 receive the upward pushing force of the circuit board 300 to move upward, and the reserved slots 2022 provide reserved spaces for the second contacting portions A1, so that the adapter board 200 can be inserted smoothly into the insertion space 14. An urging portion A3 is formed by bending upward from each of the second contacting portions A1. Each urging portion A3 urges against corresponding one stopping block 2023 of the adapter board 200. The stopping blocks 2023 stop the excessive upward movement of the second contacting portions A1, ensuring that the second contacting portions A1 are still on the same plane after being deformed elastically, so that the second contacting portions A1 maintain coplanar.

As shown in FIGS. 1, 5 and 7, the other end of the adapter board 200 is provided with a connecting region 203, and the connecting region 203 is located out of the insertion space 14. Both the first conducting region 201 and the second conducting region 202 are electrically conducted with the connecting region 203. A cable 400 is soldered correspondingly to the connecting region 203. The cable 400 includes multiple core wires (not labeled) which are correspondingly electrically connected to the first contact pads 2011 and the second contact pads 2021, so that the electrical connection between the cable 400 and the circuit board 300 is complete.

Figure 8:
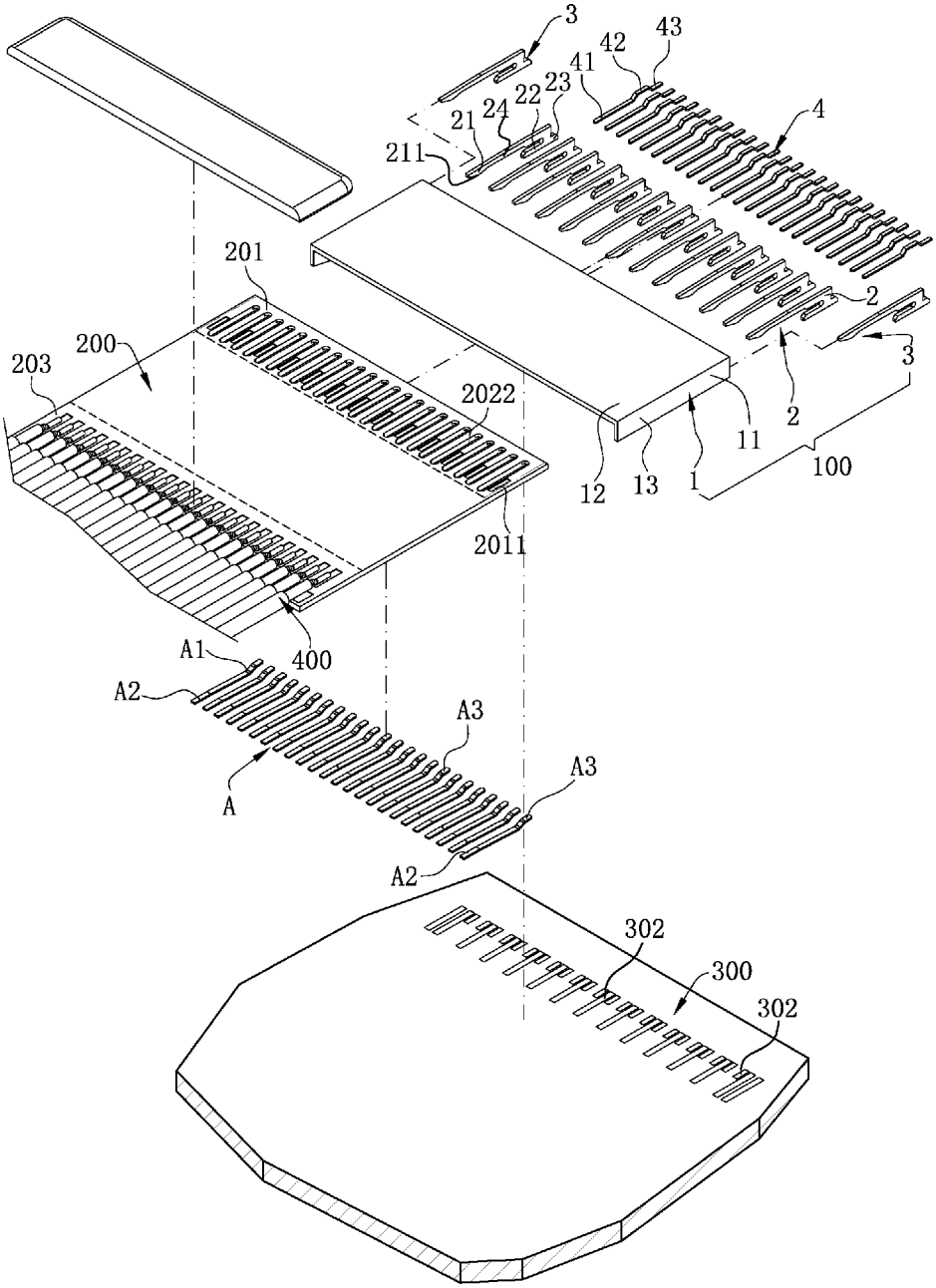
FIG. 8 is a schematic three-dimensional exploded view of a connector assembly according to a second embodiment of the present invention.
Figure 9:
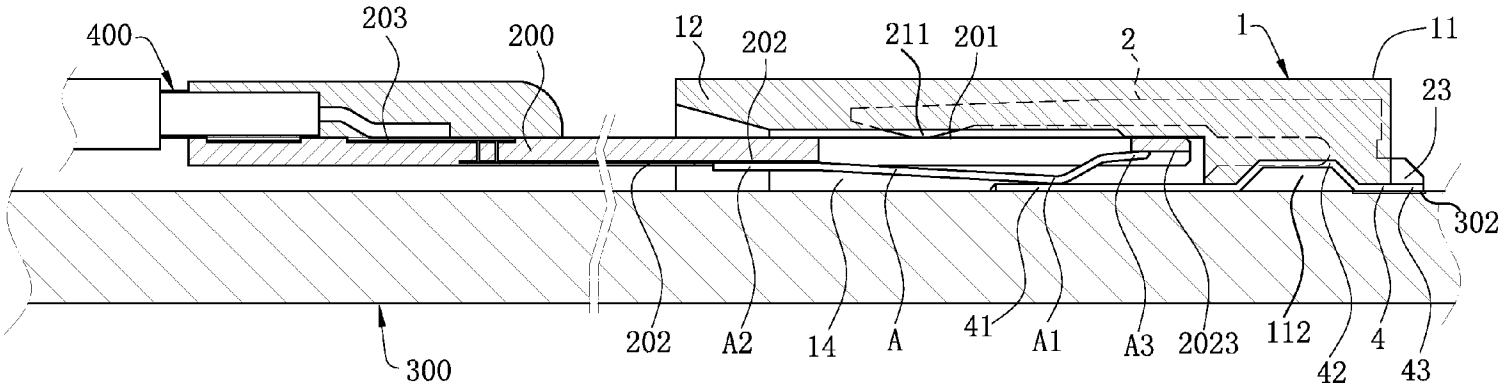
FIG. 9 is a sectional view of the connector assembly according to the second embodiment of the present invention.

FIG. 8 and FIG. 9 show a second embodiment of the present invention. Referring to FIG. 8 and FIG. 9, the difference between the second embodiment and the first embodiment of the connector assembly is as follows: the insulating body 1 is additionally provided with multiple third terminals 4. The third terminals 4 are arranged in a row on the insulating body 1, and configured to be electrically connected to the circuit board 300. The third terminals 4 are signal terminals. A pair of second terminals A are arranged between each two neighboring first terminals 2, so that the signal interference between the neighboring second terminals A can be shielded, and the third terminals 4 are configured to elastically urge against the second terminals A, so that the second terminals A are connected electrically to the circuit board 300 through the third terminals 4. Multiple second terminal slots 112 are vertically and upwardly arranged concavely from the bottom of the base 11 to fix the third terminals 4. Each third terminal 4 has a third fixing portion 42 fixed in the second terminal slot 112. A planar third contacting portion 41 extends forward from each of the third fixing portions 42. Each third contacting portion 41 has a flat plate shape, and the third contacting portions 41 protrude forward out of the second terminal slots 112 to enter the insertion space 14 to be in electrical contact with the second contacting portions A1. A third soldering portion 43 extends backward from each of the third fixing portions 42. The third soldering portions 43 are configured to be soldered to the circuit board 300. Moreover, the third soldering portions 43 and the first soldering portions 23 are in the same row, and thereby the occupied space of the circuit board 300 is reduced, which is favorable for the wiring densification of the circuit board 300. The second terminals A are plate surface-bent terminals. The plate surfaces of the first terminals 2 are perpendicular to the plate surfaces of the second terminals A, the space of the insulating body 1 is utilized sufficiently, and the size of the insulating body 1 is reduced. Since the third soldering portions 43 are soldered to the circuit board 300, when the adapter board 200 is inserted in the insertion space 14, the first contacting portions 21 elastically urge against the first contact pads 2011 to form electrical contact, the third contacting portions 41 elastically urge against the second contacting portions A1 to form electrical contact, so that signals of the circuit board 300 can be directly transmitted to the adapter board 200, and thereby the effect of shortening the path of electricity conduction and reducing the interference and attenuation of the signals can be achieved as well.

In summary, the connector assembly according to certain embodiments of the present invention has the following beneficial advantages.

(1) The first conducting region 201 of the adapter board 200 is provided with the first contact pads 2011 that are exposed to the insertion space 14 and are correspondingly in electrical contact with the first contacting portions 21, the second conducting region 202 is provided with the second contact pads 2021 that are exposed to the insertion space 14 and are correspondingly in electrical contact with the second soldering portions A2, the second contacting portions A1 are configured to be in electrical contact with the conductive sheets 301 of the circuit board 300. Thus, the adapter board 200 can directly conduct signals of the circuit board 300 to the cable 400, the path of electricity conduction is shortened, and the interference and attenuation of the signals are reduced. In addition, since the second terminals A and the first terminals 2 are arranged staggerly in the vertical direction, the cost is reduced, and the space is saved.

(2) The first contacting portions 21 are located above the first contact pads 2011 to elastically urge against the first contact pads 2011, the second contacting portions A1 are located above the circuit board 300 to elastically urge against the conductive sheets 301 of the circuit board 300. That is, the first terminals 2 and the second terminals A respectively elastically clamp the upper side and lower side of the adapter board 200 and respectively electrically urge against the first contact pads 2011 and the conductive sheets 301 of the circuit board 300, so that the adapter board 200 can be supported stably. As a result, the circuit board 300 and the electrical connector 100 can maintain stable electrical connection, and thereby the connector assembly has good signal transmission performance.

(3) The first terminals 2 are arranged in a row and are all ground terminals, and the second terminals A are arranged in a row and are all signal terminals. The horizontal projections of only two second terminals A are between the horizontal projections of each two neighboring first terminals 2. That is, one first terminal 2 is arranged between each pair of second terminals A, so the arrangement of the first terminals 2 is used to shield the signal interference between two neighboring pairs of second terminals A, reducing crosstalk interference. Moreover, the first terminals 2 are blanked terminals, and thereby the shielding effect of the first terminals 2 is better. In addition, since the first contacting portions 21 are located above the second contacting portions A1, the first terminals 2 can further shield crosstalk signals over the second contacting portions A1, and thereby the high-frequency effect of the electrical connector 100 is guaranteed.

(4) Since the base 11, the extension portion 12 and the circuit board 300 jointly define the insertion space 14, the insertion space 14 does not need to be formed by separately concaving the insulating body 1, consequently, the height of the insulating body 1 is reduced, and the size of the electrical connector 100 is reduced effectively.

(5) Since the adapter board 200 is provided with the reserved slots 2022 corresponding to the second contacting portions A1, when the adapter board 200 is inserted into the insertion space 14, the second contacting portions A1 receive the upward pushing force of the circuit board 300 to move upward, and the reserved slots 2022 provide reserved spaces for the second contacting portions A1, so that the adapter board 200 can be inserted smoothly into the insertion space 14.

(6) The stopping blocks 2023 stop the excessive upward movement of the second contacting portions A1, ensuring that the second contacting portions A1 are still on the same plane after being deformed elastically, so that the second contacting portions A1 have good coplanarity.

(7) The fixing members 3 and the first terminals 2 have the same structure and are arranged in a row, consequently, the fixing members 3 and the first terminals 2 can be formed by blanking through the same material, the separate forming of the fixing members 3 are avoided, the cost is reduced, the efficiency of production is increased, and moreover, batch production is benefited.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A connector assembly for being electrically mounted on a circuit board, comprising:

an electrical connector comprising an insulating body and a plurality of first terminals disposed in the insulating body, wherein the insulating body is provided with an insertion space, and each of the first terminals has a first contacting portion exposed to the insertion space and a first soldering portion for being soldered to the circuit board; and an adapter board inserted in the insertion space, wherein one end of the adapter board is provided with a first conducting region and a second conducting region that are located respectively on an upper surface and a lower surface of the adapter board, the first conducting region comprises a plurality of first contact pads that are exposed to the insertion space and are correspondingly in electrical contact with the first contacting portions, a plurality of second terminals are arranged on the lower surface of the adapter board, each of the second terminals has a second contacting portion and a second soldering portion, the second conducting region is provided with a plurality of second contact pads that are exposed to the insertion space and are correspondingly in electrical contact with the second soldering portions, the second contacting portions are used for electrical contacting the circuit board, and the second terminals and the first terminals are staggered in a vertical direction.

2. The connector assembly of claim 1, wherein the first terminals are arranged in a row and are all ground terminals, the second terminals are arranged in a row and are all signal terminals, and horizontal projections of two of the second terminals are disposed between horizontal projections of neighboring two of the first terminals.

3. The connector assembly of claim 1, wherein the first contact pads and the second contact pads are staggered in the vertical direction.

4. The connector assembly of claim 1, wherein the first contacting portions elastically urge against the first contact pads, and the second contacting portions elastically urge against the circuit board.

5. The connector assembly of claim 1, wherein the second contacting portions bend and extend downward from the second soldering portions, the adapter board is provided with a plurality of reserved slots corresponding to the second contacting portions, each of the reserved slots has a stopping block, an urging portion is formed by bending upward from each of the second contacting portions, and the urging portions urge against the stopping blocks of the adapter board.

6. The connector assembly of claim 1, wherein two fixing members are fixed respectively on two sides of the insulating body, the two fixing members are located respectively on outer sides of outermost two of the first terminals, and the fixing members and the first terminals have a same structure and are arranged in a row.

7. The connector assembly of claim 1, wherein the first terminals are cutting type terminals, and plate surfaces of the first terminals are perpendicular to plate surfaces of the second terminals.

8. The connector assembly of claim 1, wherein the insulating body comprises a base and an extension portion extending forward from a front end of the base, a size of the extension portion in the vertical direction is less than a size of the base, the base, the extension portion and the circuit board jointly define the insertion space, the first terminals are fixed on the base and extend to the extension portion, and the first terminals and the second terminals are located respectively on an upper portion and a lower portion of an inner side of the insertion space.

9. The connector assembly of claim 1, wherein the other end of the adapter board is provided with a connecting region, the connecting region is located out of the insertion space, both the first conducting region and the second conducting region are electrically conducted with the connecting region, a cable is soldered to the connecting region, and the cable comprises a plurality of core wires which are correspondingly electrically connected to the first contact pads and the second contact pads.

10. A connector assembly for being electrically mounted on a circuit board, comprising:

an electrical connector comprising an insulating body and a plurality of first terminals and a plurality of third terminals dispose in the insulating body, wherein the first terminals and the third terminals are configured to be connected electrically to the circuit board, the insulating body is provided with an insertion space, each of the first terminals has a first contacting portion exposed to one side of the insertion space, and each of the third terminals has a third contacting portion exposed to the other side of the insertion space; and an adapter board inserted in the insertion space, wherein one end of the adapter board is provided with a first conducting region and a second conducting region, the first conducting region and the second conducting region are located respectively on an upper surface and a lower surface of the adapter board, the first conducting region comprises a plurality of first contact pads that are exposed to the insertion space and are correspondingly in electrical contact with the first contacting portions, a plurality of second terminals are arranged on the lower surface of the adapter board, each of the second terminals has a second contacting portion and a second soldering portion, the second conducting region is provided with a plurality of second contact pads that are exposed to the insertion space and are correspondingly in electrical contact with the second soldering portions, the second contacting portions are correspondingly in electrical contact with the third contacting portions, and the second terminals and the first terminals are staggered in a vertical direction.

11. The connector assembly of claim 10, wherein the first contact pads and the second contact pads are staggered in the vertical direction.

12. The connector assembly of claim 10, wherein the first contacting portions elastically urge against the first contact pads, and the second contacting portions urge against the circuit board.

13. The connector assembly of claim 10, wherein the first terminals are arranged in a row and are all ground terminals, the second terminals are arranged in a row and are all signal terminals, and horizontal projections of two of the second terminals are disposed between horizontal projections of neighboring two of the first terminals.

14. The connector assembly of claim 10, wherein the insulating body comprises a base and an extension portion extending forward from the base, a plurality of first terminal slots are recessed from a rear end surface of the base forward, the extension portion is provided with a plurality of receiving slots correspondingly communicating with the first terminal slots, each of the first terminals has a first fixing portion fixed in corresponding one of the first terminal slots, the first contacting portions are received in the receiving slots and exposed to the insertion space, a plurality of second terminal slots are recessed from a bottom surface of the base, each of the third terminals has a third fixing portion fixed in corresponding one of the second terminal slots, and the third contacting portions protrude out of the second terminal slots and are located below the first contacting portions.

15. A connector assembly for being electrically mounted on a circuit board, the circuit board is provided with a plurality of conductive sheets and a plurality of soldering pads respectively along a longitudinal direction, and the connector assembly comprising:

an electrical connector comprising an insulating body and a plurality of first terminals disposed in the insulating body, wherein an insertion space is arranged backward from a front end surface of the insulating body, each of the first terminals has a first fixing portion fixed on the insulating body, an elastic first contacting portion extending forward from the first fixing portion and, and a first soldering portion extending backward from the first fixing portion, the first contacting portions are exposed to one side of the insertion space, the conductive sheets are located on the other side of the insertion space, and the soldering portions are located out of the insulating body in order to be electrically connected to the soldering pads; and an adapter board inserted in the insertion space, wherein one end of the adapter board is provided with a first conducting region and a second conducting region, the first conducting region and the second conducting region are located respectively on an upper surface and a lower surface of the adapter board, the first conducting region comprises a plurality of first contact pads that are exposed to the insertion space, the first contacting portions are correspondingly in electrical contact with the first contact pads above the adapter board, the second conducting region is provided with a plurality of second contact pads, a plurality of second terminals are arranged on the lower surface of the adapter board, each of the second terminals comprises a second contacting portion and a second soldering portion, the second soldering portions are correspondingly in electrical contact with the second contact pads, and the second contacting portions elastically urge downward against the conductive sheets to form an electrical connection.

16. The connector assembly of claim 15, wherein the first contact pads are located behind the second contact pads along the longitudinal direction, and are located in front of the conductive sheets.

17. The connector assembly of claim 15, wherein the second terminals and the first terminals are staggered in a vertical direction.

18. The connector assembly of claim 15, wherein the first terminals are arranged in a row and are all ground terminals, the second terminals are arranged in a row and are all signal terminals, and horizontal projections of two of the second terminals are disposed between horizontal projections of neighboring two of the first terminals.

19. The connector assembly of claim 15, wherein the second contacting portions are bend and extend downward from the second soldering portions, the adapter board is provided with a plurality of reserved slots corresponding to the second contacting portions, each of the reserved slots has a stopping block, an urging portion is formed by bending upward from each of the second contacting portions, and the urging portions urge against the stopping blocks of the adapter board.

20. The connector assembly of claim 15, wherein the other end of the adapter board is provided with a connecting region, the connecting region is located out of the insertion space, both the first conducting region and the second conducting region are electrically conducted with the connecting region, a cable is soldered to the connecting region, and the cable comprises a plurality of core wires which are correspondingly electrically connected to the first contact pads and the second contact pads.

* * * * *